US007980095B1

(12) United States Patent
Masterson

(10) Patent No.: US 7,980,095 B1
(45) Date of Patent: Jul. 19, 2011

(54) JEWELRY METHOD AND SYSTEM

(76) Inventor: Sheila A. Masterson, San Antonio, TX (US)

( * ) Notice: Subject to any disclaimer, the term of this patent is extended or adjusted under 35 U.S.C. 154(b) by 623 days.

(21) Appl. No.: 11/517,914

(22) Filed: Sep. 8, 2006

(51) Int. Cl.
*A44C 25/00* (2006.01)

(52) U.S. Cl. ..... 63/41; 63/3.1; 63/4

(58) Field of Classification Search ..... 63/1.11, 63/1.16–1.18, 3, 3.1, 3.2, 4, 33, 40, 41
See application file for complete search history.

(56) References Cited

U.S. PATENT DOCUMENTS

| | | | | |
|---|---|---|---|---|
| 1,704,919 | A | 3/1929 | Murray | |
| 2,644,992 | A * | 7/1953 | McFarland | 63/3.1 |
| 3,098,364 | A * | 7/1963 | Verri | 63/1.16 |
| 3,135,031 | A * | 6/1964 | Brosse | 63/3.1 |
| 4,527,316 | A * | 7/1985 | Murphy | 63/3.1 |
| D282,727 | S | 2/1986 | Bulgari | |
| 5,007,252 | A | 4/1991 | Mochizuki | |
| 6,438,995 | B1 * | 8/2002 | Kuptzin et al. | 63/3.1 |
| 6,675,611 | B2 * | 1/2004 | Hunter | 63/3.1 |
| 6,718,797 | B2 | 4/2004 | Plumly | |
| 6,880,363 | B2 * | 4/2005 | Ma | 63/3.1 |
| 6,962,063 | B1 | 11/2005 | Pearl | |
| 7,322,214 | B2 * | 1/2008 | Ignatowski | 63/38 |
| 7,350,376 | B2 * | 4/2008 | Couling | 63/3.1 |
| 2002/0078707 | A1 | 6/2002 | Walker | |
| 2004/0007017 | A1 * | 1/2004 | Flaherty | 63/3.1 |
| 2004/0200236 | A1 | 10/2004 | Emberson | |
| 2006/0048543 | A1 * | 3/2006 | Kessler | 63/40 |
| 2007/0051133 | A1 * | 3/2007 | Wolff | 63/35 |

* cited by examiner

*Primary Examiner* — Jack W. Lavinder
(74) *Attorney, Agent, or Firm* — Cantor Colburn LLP

(57) ABSTRACT

A method and system providing for customizable jewelry is disclosed. The customizable jewelry system comprises a plurality of jewelry strands with releasable clasps at each end and multi-connector findings. The multi-connector findings are connectors with multiple loops capable of being a connecting joint to the jewelry strands. The multi-connector findings are especially suitable for multiple layer necklaces and belts. The opposing ends of each jewelry strand can be releasably secured to one another and to multi-connector findings to form various structures suitable for use as necklace, bracelet, chain belt, or other component jewelry accessory. Each strand can be repeatedly utilized in multiple jewelry item combinations. Each strand within a jewelry structure can also be removed or substituted with another strand to achieve any configuration that is desirable for a particular outfit and setting.

9 Claims, 4 Drawing Sheets

JEWELRY METHOD AND SYSTEM

BACKGROUND OF THE INVENTION

1. Field of the Invention

This invention relates to the field of customizable jewelry. More particularly, the present invention is a system that employs combinations of multi-connector findings and strands of jewelry to form customizable necklaces, bracelets, belts, and other accessories from a single jewelry system.

2. Description of the Related Art

Many jewelry accessories such as necklace, bracelet, and chain belt have the same basic structure: a strand or strands of jewelry linked and secured by a multitude of available findings. While persons skilled in the art of jewelry making often utilize identical parts to construct different jewelry items, most jewelries sold on the market have fixed structures that are not modifiable by consumers. When a jewelry article is made with conventional jewelry making techniques, consumers loose the ability to utilize its components for other purposes. A consumer desiring several jewelry items with slight structural variations between them traditionally must purchase each jewelry items individually. Several methods and systems which permit some degree of modification and conversion between different types of jewelry are known in the art.

Some of the known arts allow conversions between different types of jewelry but do not permit modification. U.S. Pat. No. 1,704,919 issued to J. M. Murray on Oct. 10, 1924 discloses a necklace with a clasp element and corresponding elements evenly spaced along the chain. Corresponding elements attach to the clasp element to form equal-size loops which allows the chain to be worn as a bracelet. U.S. Pat. No. 6,962,063 issued to Irwin Pearl on Nov. 8, 2005 discloses an arrangement of stringed magnetic and non-magnetic beads that can be worn as a necklace or bracelet in loops about the user resulting from contact together of the magnetic beads. Both of these inventions have fixed number of convertible modes and have no exchangeable parts. These designs allow a single jewelry item to be worn on different parts of the body, but lack sufficient customizability.

Other inventions have some degree of customizability but utilize connectors that are limited to one-to-one connection. U.S. Pat. No. 5,007,252 issued to Mochizuki on Apr. 16, 1991 discloses a method of joining stone or pearl strands with imbedded connectors to inconspicuously create necklaces of different configuration. U.S. Pat. No. 6,718,797 B2 issued to Margaret Plumly on Apr. 13, 2004 discloses a jewelry finding that enables a flexible bracelet to be worn as a necklace. Locket clasps are provided at the ends of the neck accessory to provide secure interconnection of the bracelet clasp ends with the neck accessory, while at the same time enclosing and obscuring from view the connection hardware. These inventions provide methods to connect jewelry strands in a visually pleasing manner while retaining the mobility of the jewelry strands. One major disadvantage of these connectors however, is that they are limited to linear structures. As such, consumer cannot configure jewelry strands to create multiple layer jewelry.

Another group of known art provides customizability but utilizes conventional connectors that allow multiple connections only to a limited extent. U.S. Patent Application No. 2004/0200236 A1 by Shirley I. Emberson et al. discloses a lanyard convertible to jewelry. This invention includes a Y shape neckpiece and a plurality of linear pieces. Each piece has a magnet, clasp, or hook on the opposing ends that can be detachably secured to one another to form necklaces or bracelets. The Y shape neckpiece can further be attached to an ID badge or other ornamentations. U.S. Patent Application No. 2002/0078707 A1 by Darly Lea Walker et al. discloses a configurable jewelry closure comprising a series of common jewelry fasteners on links which can be detachably secured to jewelry strand(s) to form jewelry item. These two inventions are customizable, but suffer the limitation of traditional connectors. Conventional fasters such as clasps and hooks are designed for one-to-one connections. While they are capable of being concurrently connected to several other connectors, a cluster of connectors is aesthetically unpleasing and inconvenient; the removal of one clasp in a cluster can undesirably affects the connectivity of another clasp in the cluster.

In view of the above described deficiencies associated with customizable jewelry systems, the present invention has been developed to alleviate these drawbacks and provide further benefits to a user. These enhancements and benefits are described in greater detail herein below with respect to several embodiments of the present invention.

BRIEF SUMMARY OF THE INVENTION

The present invention in its several disclosed embodiments alleviates the drawbacks described above with respect to methods and systems for customizable jewelry and incorporates several additional beneficial features. The general objective of the present invention is to provide a new and improved customizable jewelry system especially suitable for creating multiple layer jewelry.

The present invention described herein is a system that employs combinations of multi-connector findings and strands of jewelry to form customizable necklaces, bracelets, and belts. Different from the clasp and loop pairing in most conventional jewelry, the jewelry strands used in the system has releasable clasps attached to both ends. The body of the strand itself can be made from any material commonly used for jewelry making. The multi-connector findings are connector pieces with multiple loops, each capable of removable attachment with the clasps on the strands. The preferred embodiment of this finding is a multi-connector-shaped metal with loops attached along the edges, and a chain and hook attached to one of the loops. The system of present invention permits jewelry strands to be detachably connected by multi-connector findings to form several types of jewelry, including necklaces, bracelets, and chain belts.

The utilization of multi-connector findings in the system of present invention has several advantages. These advantages are exemplified below by the differences between known methods of making a multiple layer necklace and the system of present invention. In the prior arts, there are two methods by which multiple layer jewelry can be constructed. Multiple layer necklaces sold on the commercial market often have the ends of each strand joined to the other strands. Such necklace has no customizability; none of the strands can be removed or replaced without causing damage to the original necklace. Another method is to wear multiple individual necklaces. When each necklace strand is put on individually however, individual strands have the tendency to rotate around the neck, resulting in connector misalignment. Although all the clasps and loops can be linked together to prevent misalignment, the process of putting on and removing such necklace can be time-consuming. The resulting cluster of clasps is also highly unaesthetic.

Using the system of the present invention, a five strand or layer necklace is constructed by connecting five jewelry strands between two multi-connector findings each having chain and hook attachment. Such necklace has several advantages over the conventional ones described above. First of all, each strand on the necklace is removable and replaceable. Consumer can remove or replace each strand to achieve a style that best accompany an outfit and/or occasion. The same strands can also be utilized to form other types of accessories. Secondly, each clasp on the jewelry strands is attached to an individual loop on a multi-connector finding, independent from other clasps. The incorporation of multi-connector findings not only eliminates the clustered appearance, each strand can also be removed and replaced without effecting any other connection. Thirdly, once the necklace is assembled, the entire necklace can be easily worn and removed through a single pair of connectors extending from the multi-connector findings. Individual strands are secured from becoming misaligned, while the undesired rotation of the entire necklace around the neck is as easy to adjust as a single strand necklace. Finally, these multi-connector findings are also capable of being decorative objects themselves, thereby increasing the overall aesthetic appeals of the jewelry.

The present invention will be more clearly understood from the following description of illustrative embodiments thereof, to be read by way of example and not of limitation in conjunction with the apparatus and the method described. The beneficial effects described above apply generally to the examples disclosed herein of the method and apparatus for customizable jewelry. The specific components and configurations through which these benefits are delivered will be described in detail herein below.

BRIEF DESCRIPTION OF THE SEVERAL VIEWS OF THE DRAWINGS

The invention will now be described in greater detail in the following way of example only and with references to the attached drawings, in which.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
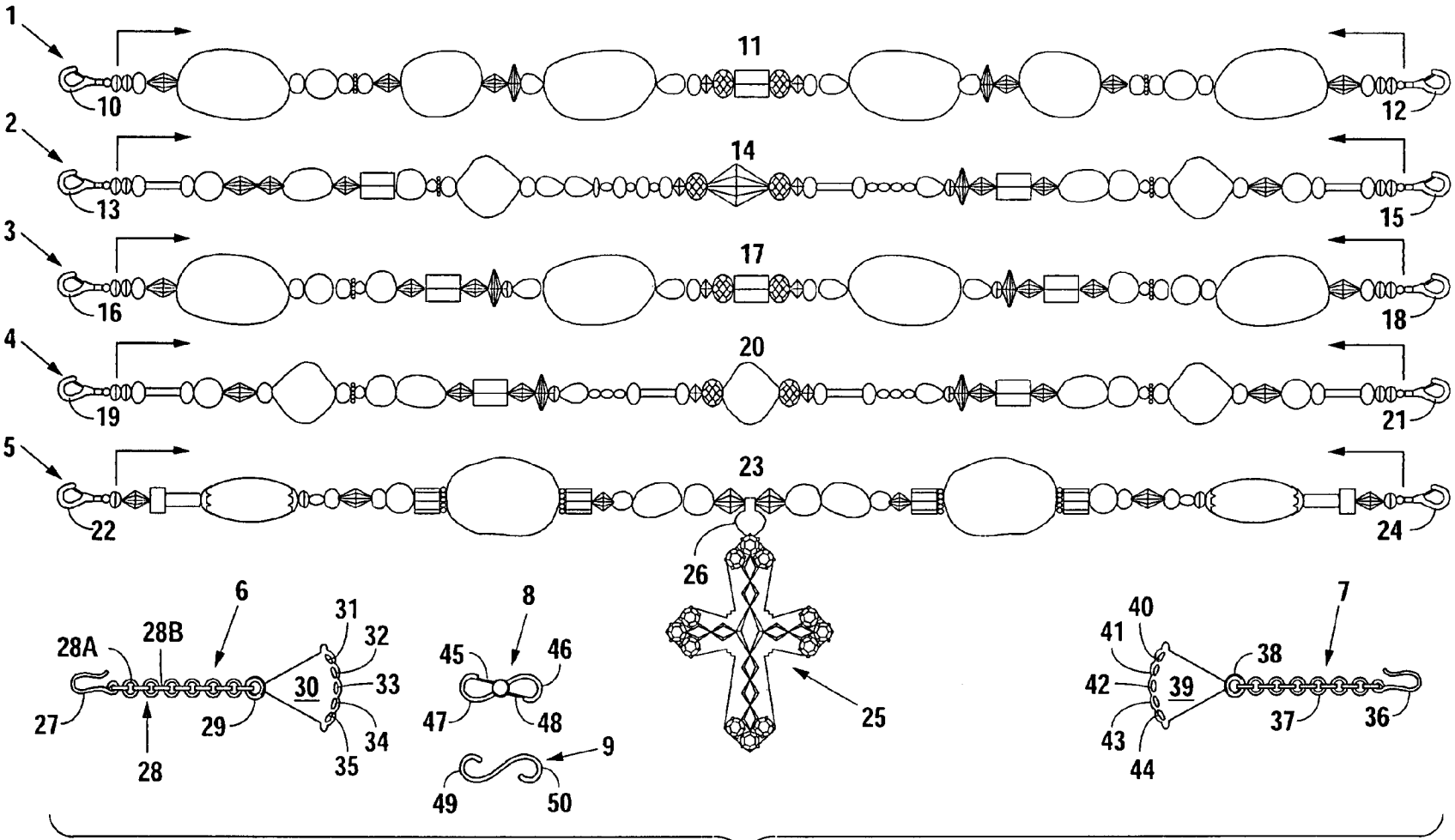
FIG. 1 shows the elements used in the preferred embodiment of the present invention.

The present invention is a customizable jewelry system. FIG. 1 shows components of one embodiment of this system. Jewelry strands 1, 2, 3, 4, and 5 have a first standard releasable clasp 10, 13, 16, 19, and 22 respectively on one end which are each attached to a thread (not visible in the illustration) on the non-clasp end. The preferred embodiment uses a metal wire thread; however, a wire or a thread made from materials commonly used in the art for similar purposes can alternatively be employed. A number of precious and semi-precious stones and beads 11, 14, 17, 20, and 23 are stringed on the thread. Strands 11, 14, 17, 20, and 23 can also contain other components commonly used in jewelry making, including but not limited to stones, pearls, beads of manmade or natural materials, shells, charms, pendants, and iockets. Strands 11, 14, 17, 20, and 23 can also be entirely replaced by standard jewelry chains or ribbons. Jewelry strand 5 is specifically shown with an optional removable pendent 25 which hangs from the thread through a releasable connector 26.

A second standard releasable lobster claw clasp means 12, 15, 18, 21, and 24 closes off each strand on the opposite end, with its non-clasp end attached to the thread. The standard releasable clasp means shown in the illustrations are lobster claw clasps. Other clasp means commonly known to persons skilled in the art, including, but not limited to, spring ring clasps, toggle clasps, and hooks, can be used in place of the lobster claw clasp. Also, all five jewelry strands 1, 2, 3, 4, and 5 are drawn to be substantially equal in length in the illustration; however, the invention can be implemented with jewelry strands of varying lengths.

Figure 4:
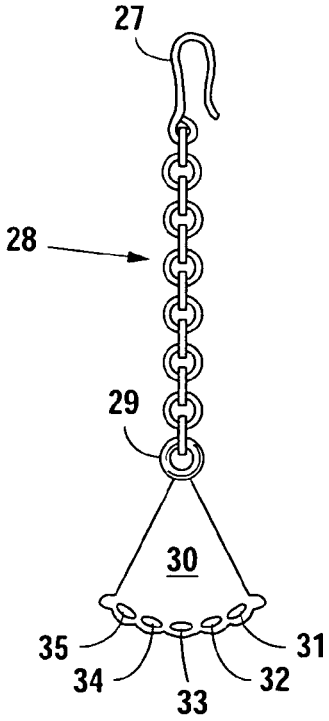
FIG. 4 shows a front view of an embodiment of a multi-connector finding having chain and hook attachment.

Connector module 6 comprises a standard releasable hook 27, a short chain 28, and a multi-connector finding 30 shown in FIG. 1 and FIG. 4. Multi-connector finding 30 is a small metal plate roughly 2-3 mm in thickness, and is generally triangular with one of the sides slightly arched outward. The multi-connector finding 30 can be made of any standard jewelry metal or plastic material. The flat surfaces of the multi-connector 30 are capable of being canvases for optional decorative designs, such as the embossed or stamped or cast stylized mark of the vendor. Five small elliptical adjacent openings or loops 31, 32, 33; 34, and 35 are formed in succession in the rim of the curved edge in a way that the major axes of each elliptical openings or loops are roughly tangential to the curved edge at the point of attachment. A larger circular loop 29 is connected to the multi-connector 30 opposite the curved edge, with its diameters parallel to the face plane of the desk 30.

Multi-connector findings of other shapes and designs can alternatively be employed; some of these examples are illustrated and described in FIGS. 2A-2F and FIG. 3 below. A chain 28, made from alternating larger circular links 28A and smaller elliptical links 28B, is attached to the triangular multi-connector 30 through loop 29. Other chains commonly used in the art can be employed alternative, as long as a hook or a clasp can attach to at least part of the chain. A hook 27 is attached to the other end of the chain 28 at its non-hook side. Connector module 7 is identical to connector module 6 as described above (replacing 27-35 with 36-44 respectively).

A double ended releasable connector 8 or an S-shaped connector 9 shown in FIG. 1 can be used in place of the hooks 27 and 36, or any of the lobster claw clasps 10, 12, 13, 15, 16, 18, 19, 21, 22, and 24. Connector 9 is a double ended hook, with the openings of the hooks 49 and 50 facing in opposite directions, forming the shape of the letter "S." Connector 8 shown in FIG. 1 and FIG. 5 has the same basic S-shaped structure formed by hooks 47 and 46 and two additional movable pieces 45 and 48 at the opening of the hooks, forming the shape of Roman numeral 8. Movable pieces 45 and 48 open to allow linking and unlinking with another element, and close to prevent unintended unlinking during more vigorous movements.

Now referring to FIG. 2, examples of a multi-connector finding are illustrated. FIG. 2A shows an enlarged view of multi-connector 30 in FIG. 1 and is described previously.

Figure 2A:
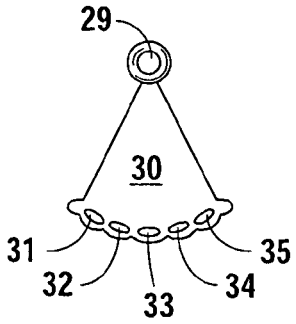
FIGS. 2A-B shows front views of six embodiments of a multi-connector finding.
Figure 2B:
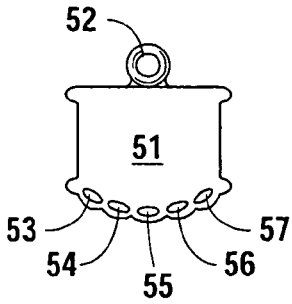

FIG. 2B shows an example of a multi-connector finding that can be used in the system of present invention. Multi-connector 51 shown in FIG. 2B is generally rectangular in shape, with all four corners rounded and slightly protruding outward towards the shorter sides. One of the long sides of multi-connector 51 arches outward. Five elliptical openings or loops 53, 54, 55, 56, and 57 are attached to the rim of the arched edge, with their major axes roughly tangential to the arch at the point of attachment. A larger circular loop 52 is attached at the center of the opposite side, with its diameters parallel to the face planes of the multi-connector 51.

Figure 2C:
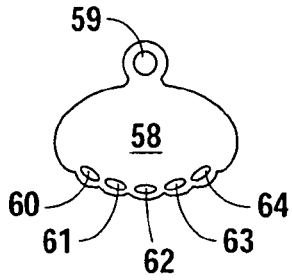

FIG. 2C shows another example of a multi-connector finding that can be used in the system of present invention. Multi-connector 58 is generally elliptical in shape and is shown with its major axis positioned horizontally. Five small elliptical openings or loops 60, 61, 62, 63, and 64 are attached along the rim of the lower arch of the multi-connector 58 in a way that their major axes are roughly tangential to the curvature of the lower arch at the point of attachment. A larger circular ring 59 is attached to the center of the rim of the upper arch, with its diameters parallel to the face planes of the multi-connector 58.

Figure 2D:
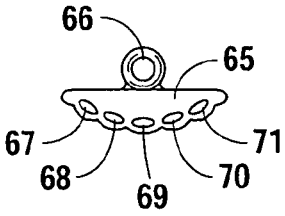

FIG. 2D shows another example of a multi-connector finding that can be used in the system of present invention. Multi-connector 65 resembles the shape of a circular segment, formed by a straight edge and a curved edge. Five small elliptical openings or loops 67, 68, 69, 70, and 71 are attached to the rim of the curved edge, each with their major axes roughly tangential to the curvature of the edge at the point of attachment. One larger circular loop 66 is attached to the center of the straight edge, with its diameters parallel to the face planes of the multi-connector 58.

Figure 2E:
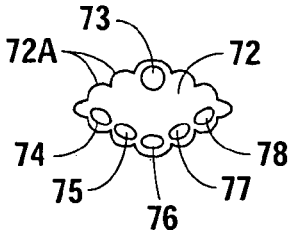

FIG. 2E shows another example of a multi-connector finding that can be used in the system of present invention. Multi-connector 72 is approximately diamond-shaped, with all four corners rounded. Each of the four sides has two semi-circle protrusions 72A along the edge. Each protrusion's diameter is around one third of the length of each side. A round hole 73 is perforated near one of the wider corners of the diamond-shape multi-connector 72. One smaller elliptical hole 76 is perforated near the opposite corner. Four more elliptical holes 74, 75, 77, and 78 are place along the two sides adjacent to hole 76, in such a way that each hole is outlined by a semi-circle protrusion on those two sides.

Figure 2F:
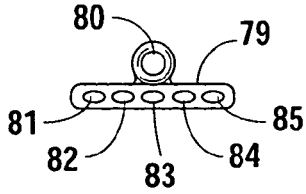

FIG. 2F shows another example of a multi-connector finding that can be used in the system of present invention. Multi-connector 79 is roughly a narrow rectangular bar with rounded corners. Five elliptical holes 81, 82, 83, 84, and 85, are perforated linearly and evenly spaced along the length of the bar 79 in a way that the major axes of the holes are parallel to the length of the bar. A larger circular loop 80 is attached to the center of one of the long edge of the rectangular bar 79 with its diameters parallel to the face planes of the bar 79.

Figure 3:
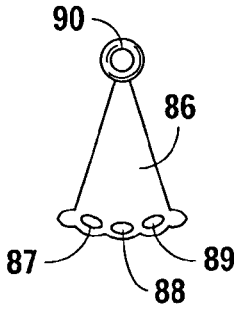
FIG. 3 shows a front view of another embodiment of a multi-connector finding.

FIG. 3 shows another example of a multi-connector finding that can be used in the system of present invention. The multi-connector 86 is generally triangular with one of the sides curved outward. Three elliptical openings or loops 87, 88, and 89 are attached to the rim of the curved edge, each with their major axes roughly tangential to the curvature of the edge at the point of attachment. A larger circular loop 90 protrudes from the corner opposite the curved edge with its diameters parallel to the face planes of the multi-connector 86.

FIG. 4 shows an enlarged view of connector module 6, and is described previously with reference to FIG. 1.

Figure 5:
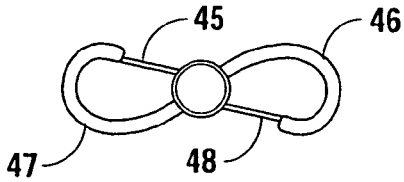
FIG. 5 shows a front view of an double ended connector.

FIG. 5 shows an enlarged view of connector 8, and is described previously with reference to FIG. 1.

The material of multi-connector findings illustrated previously has been described herein as metal. However, the particular material of the multi-connector is not a critical aspect of this invention. Multi-connector findings can alternatively be made with wood, polymer, stone, leather, or a number of other natural or man-made materials.

Figure 6A:
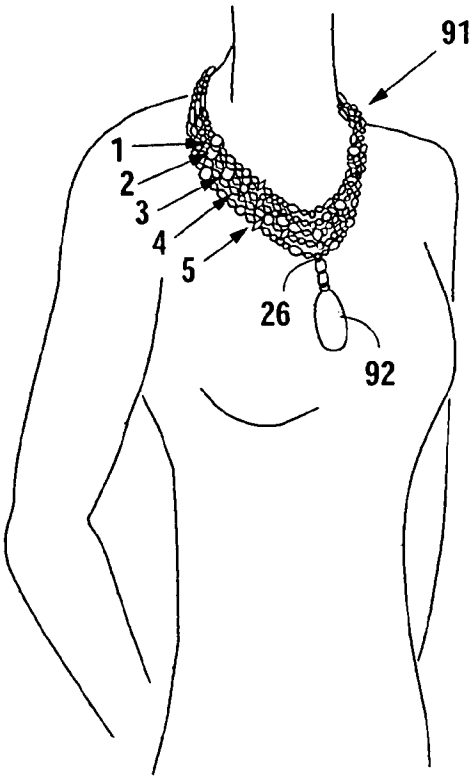
FIG. 6A shows a perspective view of a necklace assembled with the system of present invention.
Figure 6B:
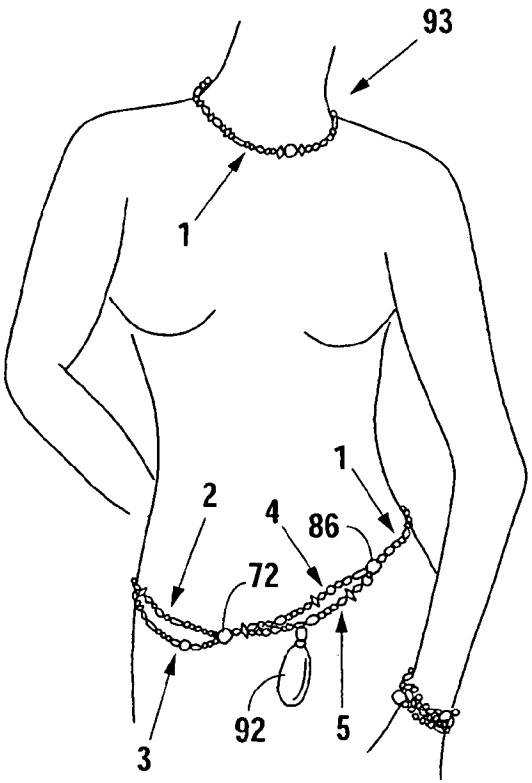
FIG. 6B shows a perspective view of a necklace, a belt, and a bracelet assembled with the system of present invention.
Figure 6C:
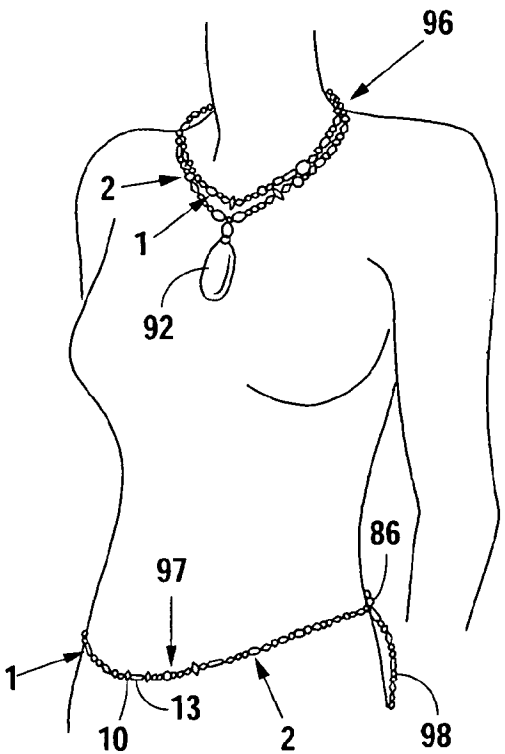
FIG. 6C shows a perspective view of a necklace and a belt assembled with the system of present invention.
Figure 7:
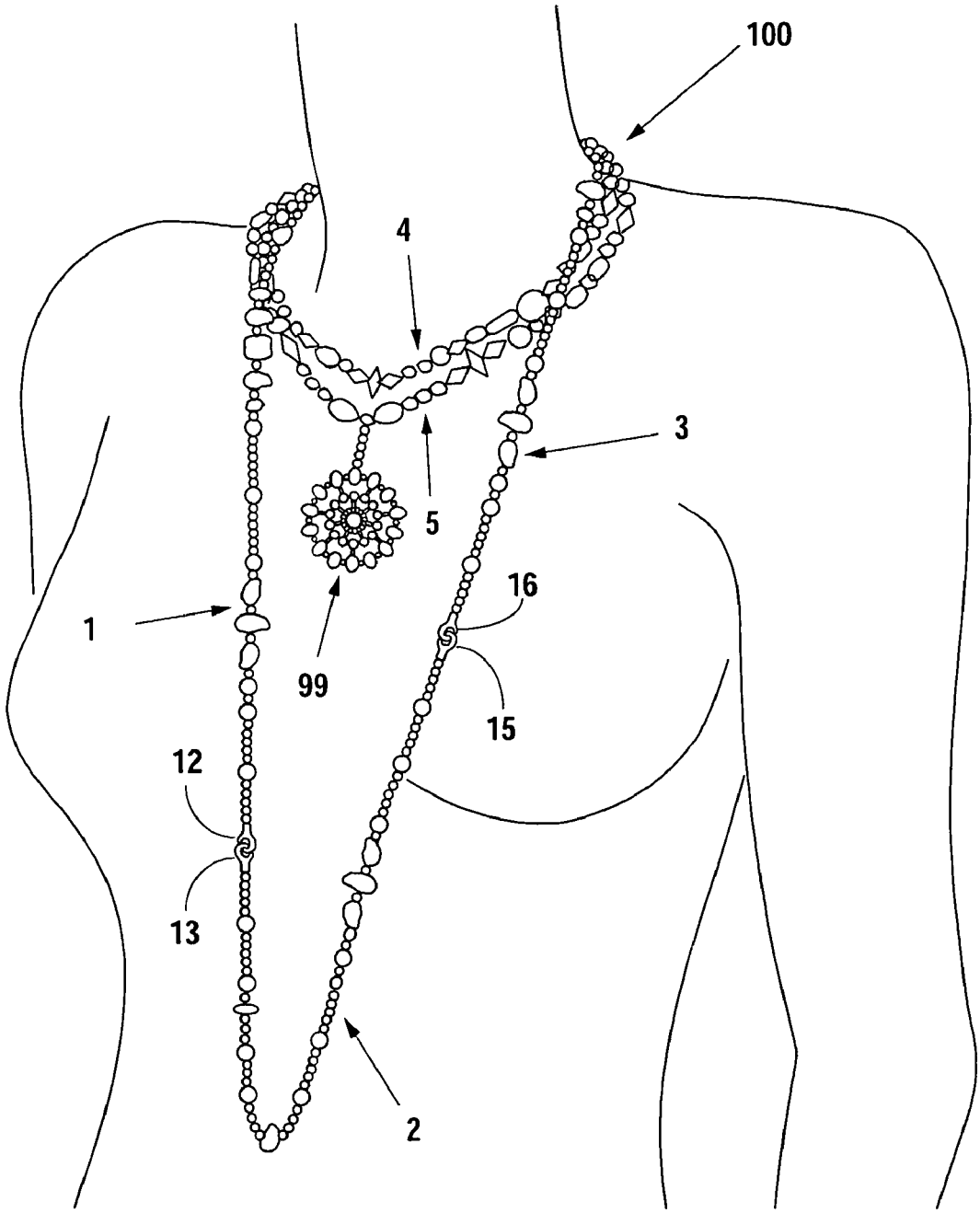
FIG. 7 shows a perspective view of a necklace assembled with the system of present invention.

FIG. 6 and FIG. 7 show several specific examples of jewelry items assembled using the system in the present invention. The system is designed to maximize customizability; as a result, numerous combinations are possible. Following illustrations are intended to serve as examples only. Further more, descriptions of these assembled jewelry item name specific elements from previous illustrations, but most elements are interchangeable with other elements of similar functionality. For example, multi-connectors 30, 51, 58, 65, 72, and 79 are all interchangeable. Other special finding designs that are rendered obvious to a person skilled in the art from the examples given can also be alternatively employed. Similarly, each jewelry strand, pendent, and clasp can be replaced by a number of alternatives that are obvious to a person skilled in the art, whether or not it is described herein.

One specific combination of the invention is shown in FIG. 6A, a five strand or layer necklace 91 configured with components from FIG. 1. Necklace 91 comprises jewelry strands 1, 2, 3, 4, and 5, and connector modules 6 and 7 (not visible in FIG. 6A but shown in FIG. 1 and FIG. 4). Necklace 91 is assembled by securing each jewelry strand between the two connector modules: clasp 10 to loop 31, clasp 13 to loop 32, clasp 16 to loop 33, clasp 19 to loop 34, clasp 22 to loop 35, clasp 12 to loop 40, clasp 15 to loop 41, clasp 18 to loop 42, clasp 21 to loop 43, and clasp 24 to loop 44. The necklace is worn and removed by connecting and disconnecting hook 36 and chain 28. In FIG. 6A, the cross-shaped pendent 25 is replaced by an oval shaped pendent 92. The system of present invention allows consumers to arrange jewelry strand 1, 2, 3, and 4, and 5 differently from what is shown and described above, or replace any of the jewelry strands with other strands not shown in the illustration.

FIG. 6B shows a necklace 93, a belt 94, and a bracelet 95 each assembled using the system of present invention. One specific combination of the invention that forms a single strand necklace 93 comprises jewelry strands 1 and 2 and connector module 6 (not visible in this illustration). This necklace is assembled by connecting clasp 10 to loop 33 and clasp 12 to one of the circular links on chain 38. While a necklace can be formed by simply linking clasp 10 and 12 of jewelry strand 1 or hooking a selected number of the strands 1, 2, 3, 4 and 5 in series, the addition of connector module 6 makes the length of the necklace adjustable.

One specific combination of the invention that forms a multiple layer belt 94 is assembled with jewelry strands 1, 2, 3, 4, and 5, multi-connector 72, multi-connector 86, shown in FIG. 3, and connector module 6 (not visible in this illustration). This belt has three sections; strand 1 forms the right section, strands 4 and 5 forms the middle section, and strands 2 and 3 form the left section. Although this configuration can be achieved by directly linking clasps of the jewelry strands together, clutters of three or four claps are not aesthetically pleasing and the length of the belt will not have adjustable length. Instead, according to the present invention, each of the sections is connected to another through multi-connector findings. Specifically, strands 4 and 5 are linked between multi-connector findings 72 and 88 by attaching clasp 22 to loop 76, clasp 24 to loop 80, clasp 29 to loop 78, and clasp 21 to loop 87. In this illustration, the cross-shaped pendent 25 from FIG. 1 is replaced by an oval shaped one 92. In the left section, strands 2, 3 are linked between multi-connector 72 and connector module 6 by connecting clasp 16 to loop 73, clasp 13 to loop 74, clasp 15 to loop 34, and clasp 18 to loop 32. Strand 1 is clasped onto loop 90 of multi-connector 86 to from the single strand right section. Finally, the remaining unconnected clasp 10 of strand 1 can be clasped onto any part of connector module 6 for desirable length.

A bracelet 95 can be made with one or more jewelry strands and one multi-connector finding. One specific combination of a bracelet made from the system of present invention includes jewelry strand 2 and multi-connector 86. Jewelry strand 2 is first connected to loop 88 of multi-connector 86 at its clasp 13, then wrapped around the wearer's wrist two to three times, and finally connected back to loop 90 on multi-connector 86 at its clasp 15. In the case of a single strand bracelet, the multi-connector 86 acts as a pendent or a charm. When multiple strands are used, the multi-connector prevents the strands from separating during movement.

FIG. 6C shows a necklace 96 and a belt 97 both also assembled using the system of present invention. Necklace 96 is a modified version of the necklace 91 shown in FIG. 6A. In FIG. 6C, strands 1, 2, 3 are removed from the necklace 96 leaving only two strands 4 and 5 and a pendent 92 on the necklace. The necklace is then shortened by repositioning hook 27 on chain 37.

Single layer belt 91 includes jewelry strands 1, 2, and 98, and multi-connector finding 86. Jewelry strands 1 and 2 are first linked together by connecting clasp 10 to clasp 13. Clasp 12 on strand 1 and clasp 15 on strand 2 are then attached to loops 87 and 89 on multi-connector 86, respectively. A shorter jewelry strand 98 is attached to loop 90 of multi-connector finding 86 to from a Y-shape for ornamental purposes. An alternative version of this belt replaces strand 98 with a chain similar to the one attached to connector module 6. Clasp 15 on strand 2 would alternatively be connected to links chain 98 to form an adjustable length chain belt.

FIG. 7 shows a multiple layer differential length necklace assembled with the system of present invention. One specific combination of a differential length necklace 100 is assembled from five jewelry strands 1, 2, 3, 4, and 5, two connector modules 6 and 7, and a pendent 99. This necklace is a modified version of necklace 91 from FIG. 6A. To convert necklace 91 to necklace 100, clasp 12 on strand 1, clasp 16 on strand 3, and both clasps on strand 2 are detached from connector modules 6 and 7. Clasp 12 is then attached to clasp 13, and clasp 15 to clasp 16. The resulting necklace has two shorter strands 4 and 5 and a long strand formed by connecting strands 1, 2, and 3 linearly. In the illustration, the oval shaped pendent 92 is replaced by a flower-shaped pendent 99.

Although the foregoing specific details describe various embodiments of the invention, persons reasonably skilled in the art will recognize that various changes may be made in the details of the method and apparatus of this invention without departing from the spirit and scope of the invention as defined in the appended claims. Therefore, it should be understood that, unless otherwise specified, this invention is not to be limited to the specific details shown and described herein.

What is claimed and desired to be secured by Letters Patent is as follows:

1. A customizable jewelry system comprising:

at least five jewelry strands of substantially the same lengths with each having a first releasable clasp means and a second releasable clasp means at each end;

at least two multi-connector findings with each having five multiple connection loops on one side, a chain attached to a loop on the side opposed to the multiple connection loops, and a releasable clasp means attached to the chain, each loop capable of being releasably attached by the clasp means on each jewelry strand to the loops in multi-connector findings and the clasp means and chain attached to each finding can be releasably attached to the strands or the clasp means and chain on the other finding to form a multi-strand necklace or other combination;

wherein the releasable clasp means on the plurality of jewelry strands and the loops on the at least two multi-connector findings, respectively, can be assembled into various combinations of strands and multi-connector findings to form jewelry accessories selected from necklaces, bracelets, belts, or any combination thereof; and wherein the circumferential length of any of the jewelry accessories employing at least one of the multi-connector findings is adjustable.

2. The customizable jewelry system as claimed in claim 1, wherein the jewelry strands comprise semi-precious stones and beads strung on a metal wire thread.

3. A method of customizing a jewelry system comprising:

releasably connecting at least five jewelry strands of substantially the same lengths to at least two multi-connector findings, each strand having a first releasable clasp means and a second releasable clasp means at each end for releasably attaching to the at least two multi-connector findings, each multi-connector finding having at least five connection loops on one side, a chain attached to a loop on the side opposed to the multiple connection loops, and a releasable clasp means attached to the chain, the first and second releasable clasp means on each jewelry strand respectively capable of being releasably attached to the loops in multi-connector findings, and the clasp means and chain attached to each finding respectively can be releasably attached to the strands or the clasp means and chain on another finding to form a multi-strand necklace or other combination;

selectively releasing the releasable clasp means on the plurality of jewelry strands from the respective loops on the at least two multi-connector findings; and assembling the strands into selected combinations of strands and multi-connector findings to form jewelry accessories selected from necklaces, bracelets, belts, or any combination thereof, wherein the circumferential length of any of the jewelry accessories employing at least one of the multi-connector findings is adjustable.

4. The method as claimed in claim 3, wherein the jewelry strands comprise semi-precious stones and beads strung on a metal wire thread.

5. A customizable jewelry system comprising:

a plurality of jewelry strands with each respectively having first and second releasable clasps at each end;

at least two multi-connector findings releasably attached to at least one of the plurality of jewelry strands, at least one of the multi-connector findings being releasably connected to the first releasable clasp and another of the multi-connector findings releasably connected to the second releasable clasp of the respective jewelry strand, a first chain having first and second ends, the first chain attached to at least one of the multi-connector findings at the first end;

a first chain clasp attached to the second end of the first chain to releasably attach to the other multi-connector finding;

a second chain having first and second ends, the second chain being attached to the other multi-connector finding at the first end and releasably attached to the first chain clasp at any position on the second chain from the first end to the second end; and a second chain clasp attached to the second end of the second chain, and the second chain clasp capable of being releasably attachable to the first chain clasp or any position on the first chain from the first end to the second end;

wherein the circumferential length of the jewelry system is adjustable.

6. The customizable jewelry system as claimed in claim 5, wherein the first, second, first chain, and second chain clasps are independently a lobster clasp, ring clasp, toggle clasp, S-shaped clasp, double ended releasable clasp, or a hook.

7. The customizable jewelry system as claimed in claim 5, wherein the first and second releasable clasps of the jewelry strands the first chain clasp of the first chain, and the second chain clasp of the second chain are independently a lobster clasp, ring clasp, toggle clasp, S-shaped clasp, double ended releasable clasp, or a hook.

8. An adjustable length, customizable jewelry system comprising:

a plurality of jewelry strands with each respectively having first and second releasable clasps at each end;

at least one multi-connector finding releasably attached to at least one of the plurality of jewelry strands, the at least one multi-connector finding being releasably connected to the first releasable clasp of the at least one of the plurality of jewelry strands, the jewelry strands comprising semi-precious stones and beads strung on a metal wire thread;

a first chain comprising a plurality of links and having first and second ends, the first chain attached to the at least one multi-connector finding at the first end;

a first chain clasp attached to the second end of the first chain;

a second chain having first and second ends, the second chain being attached to another multi-connector finding at the first end and releasably attached to the first chain at any position on the second chain from the first end to the second end; and a second chain clasp attached to the second end of the second chain, and the second chain clasp being releasably attachable to the first chain clasp or any position on the first chain from the first end to the second end;

wherein the circumferential length of the jewelry system is adjustable by releasably attaching the second releasable clasp of the at least one of the plurality of jewelry strands to any link of the first chain.

9. The customizable jewelry system as claimed in claim 8, wherein the first and second releasable clasps of the jewelry strands the first chain clasps clasp of the first chain, and the second chain clasp of the second chain are independently a lobster clasp, ring clasp, toggle clasp, S-shaped clasp, double ended releasable clasp, or a hook.

* * * * *